US010332526B2

(12) United States Patent
Beack et al.

(10) Patent No.: US 10,332,526 B2
(45) Date of Patent: Jun. 25, 2019

(54) AUDIO ENCODING APPARATUS AND METHOD, AND AUDIO DECODING APPARATUS AND METHOD

(71) Applicants: Electronics and Telecommunications Research Institute, Daejeon (KR); THE KOREA DEVELOPMENT BANK, Seoul (KR)

(72) Inventors: Seung Kwon Beack, Daejeon (KR); Tae Jin Lee, Daejeon (KR); Jong Mo Sung, Daejeon (KR); Kyeong Ok Kang, Daejeon (KR); Keun Woo Choi, Daejeon (KR)

(73) Assignees: Electronics and Telecommunications Research Institute, Daejeon (KR); THE KOREA DEVELOPMENT BANK, Seoul (KR)

( * ) Notice: Subject to any disclaimer, the term of this patent is extended or adjusted under 35 U.S.C. 154(b) by 0 days.

(21) Appl. No.: 15/652,055

(22) Filed: Jul. 17, 2017

(65) Prior Publication Data

US 2017/0316786 A1 Nov. 2, 2017

Related U.S. Application Data

(63) Continuation of application No. 14/423,366, filed as application No. PCT/KR2013/007531 on Aug. 22, 2013, now Pat. No. 9,711,150.

(30) Foreign Application Priority Data

Aug. 22, 2012 (KR) ..... 10-2012-0091569
Aug. 22, 2013 (KR) ..... 10-2013-0099466

(51) Int. Cl.
*G10L 19/00* (2013.01)
*G10L 19/02* (2013.01)
(Continued)

(52) U.S. Cl.
CPC ..... *G10L 19/0017* (2013.01); *G10L 19/008* (2013.01); *G10L 19/002* (2013.01); *G10L 19/0212* (2013.01); *G10L 19/22* (2013.01)

(58) Field of Classification Search
CPC ..... G10L 19/0017; G10L 19/24
See application file for complete search history.

(56) References Cited

U.S. PATENT DOCUMENTS 6,370,502 B1 4/2002 Wu et al.
7,536,305 B2 5/2009 Chen et al.
(Continued)

FOREIGN PATENT DOCUMENTS

KR 20100041678 A 4/2010
KR 20100129683 A 12/2010
(Continued)

OTHER PUBLICATIONS

T. Liebchen and Y. A. Reznik, "MPEG-4 ALS: an emerging standard for lossless audio coding," Data Compression Conference, 2004. Proceedings. DCC 2004, 2004, pp. 439-448. (Year: 2004).*
(Continued)

*Primary Examiner* — Brian L Albertalli
(74) *Attorney, Agent, or Firm* — William Park & Associates Ltd.

(57) ABSTRACT

An audio encoding apparatus to encode an audio signal using lossless coding or lossy coding and an audio decoding apparatus to decode an encoded audio signal are disclosed. An audio encoding apparatus according to an exemplary embodiment may include an input signal type determination unit to determine a type of an input signal based on characteristics of the input signal, a residual signal generation unit to generate a residual signal based on an output signal
(Continued)

from the input signal type determination unit, and a coding unit to perform lossless coding or lossy coding using the residual signal.

7 Claims, 11 Drawing Sheets

(51) Int. Cl.

| | |
|---|---|
| ***G10L 19/22*** | (2013.01) |
| ***G10L 19/002*** | (2013.01) |
| ***G10L 19/008*** | (2013.01) |

(56) References Cited

U.S. PATENT DOCUMENTS

| | | | |
|---|---|---|---|
| 2003/0171919 | A1 | 9/2003 | Kim et al. |
| 2004/0044520 | A1 | 3/2004 | Chen et al. |
| 2004/0044521 | A1 | 3/2004 | Chen et al. |
| 2004/0044534 | A1 | 3/2004 | Chen et al. |
| 2007/0043575 | A1 | 2/2007 | Onuma et al. |
| 2009/0106031 | A1 | 4/2009 | Jax et al. |
| 2009/0164226 | A1 | 6/2009 | Boehm et al. |
| 2009/0248424 | A1 | 10/2009 | Koishida et al. |
| 2009/0262945 | A1 | 10/2009 | Teo et al. |
| 2009/0306993 | A1 | 12/2009 | Wuebbolt et al. |
| 2011/0224991 | A1 | 9/2011 | Fejzo |
| 2012/0128162 | A1 | 5/2012 | Chen et al. |
| 2012/0290306 | A1 | 11/2012 | Smyth et al. |
| 2013/0197919 | A1* | 8/2013 | Li ..... G10L 19/24 704/500 |

FOREIGN PATENT DOCUMENTS

| | | | |
|---|---|---|---|
| WO | 2010005272 | A2 | 1/2010 |
| WO | 2014030938 | A1 | 2/2014 |

OTHER PUBLICATIONS

Geiger, Ralf, et al. "MPEG-4 Scalable to Lossless Audio Coding." Audio Engineering Society Convention 117. Audio Engineering Society, 2004.

Li, Te, Susanto Rahardja, and Soo Ngee Koh. "Switchable bit-plane coding for high-definition advanced audio coding." International Conference on Multimedia Modeling. Springer Berlin Heidelberg, 2007.

Takehiro Moriya et al., A Design of Lossy and Lossless Scalable Audio Coding, IEEE, 2000, pp. 889-892, NTT Laboratories,Toyko, Japan.

Yu, Rongshan et al. "A fine granular scalable perceptually lossy and lossless audio codec." Proceedings of the 2003 International Conference on Multimedia and Expo—vol. 2. IEEE Computer Society, 2003.

Yu, Rongshan, et al. "A fine granular scalable to lossless audio coder." IEEE Transactions on Audio, Speech, and Language Processing 14.4 (2006): 1352-1363.

Yu, Rongshan, et al. "A scalable lossy to lossless audio coder for MPEG-4 lossless audio coding." Acoustics, Speech, and Signal Processing, 2004. Proceedings.(ICASSP'04). IEEE International Conference on. vol. 3. IEEE, 2004.

Yu, Rongshan, et al. "Improving coding efficiency for MPEG-4 Audio Scalable Lossless coding." Proceedings. (ICASSP'05). IEEE International Conference on Acoustics, Speech, and Signal Processing, 2005.. vol. 3. IEEE, 2005.

* cited by examiner

AUDIO ENCODING APPARATUS AND METHOD, AND AUDIO DECODING APPARATUS AND METHOD

TECHNICAL FIELD

The present invention relates to an audio encoding apparatus for encoding an audio signal and an audio decoding apparatus for decoding an audio signal.

BACKGROUND ART

Conventionally, lossy coding and lossless coding are separately developing. That is, most lossless compression techniques focus on lossless compression functions, while lossy coding methods are aimed at enhancing compression efficiency regardless of lossless compression.

Traditional technology, such as Free Lossless Audio Codec (FLAC) or Shorten, performs lossless coding as follows. An input signal is subjected to a prediction encoding module to form a residual signal via, and the residual signal is subjected to a "Residual Handing" module, such as a differential operation, in order to reduce a dynamic range thereof, so that a residual signal with a reduced dynamic range is output. The residual signal is expressed as a bitstream by entropy coding as a lossless compression technique and transmitted. In most lossless compression techniques, the residual signal is compressed and encoded through one entropy coding block. FLAC employs Rice coding, while Shorten uses Huffman coding.

DISCLOSURE OF INVENTION

Technical Solutions

According to an aspect of the present invention, there is provided an audio encoding apparatus including an input signal type determination unit to determine a type of an input signal, a residual signal generation unit to generate a residual signal based on an output signal from the input signal type determination unit, and a coding unit to perform lossless coding or lossy coding using the residual signal.

According to an aspect of the present invention, there is provided an audio decoding apparatus including a bitstream reception unit to receive a bitstream including a coded audio signal, a decoding unit to perform lossless decoding or lossy decoding based on a coding method used to code the audio signal, and a reconstruction unit to reconstruct an original audio signal using a residual signal generated by the lossless decoding or lossy decoding.

According to an aspect of the present invention, there is provided an audio encoding method conducted by an audio encoding apparatus, the audio encoding method including determining a type of an input signal, generating a residual signal based on the input signal, and performing lossless coding or lossy coding using the residual signal.

According to an aspect of the present invention, there is provided an audio decoding method conducted by an audio decoding apparatus, the audio decoding method including receiving a bitstream including a coded audio signal, performing lossless decoding or lossy decoding based on a coding method used to code the audio signal, and reconstructing an original audio signal using a residual signal generated by the lossless decoding or lossy decoding.

BEST MODE FOR CARRYING OUT THE INVENTION

Figure 1:
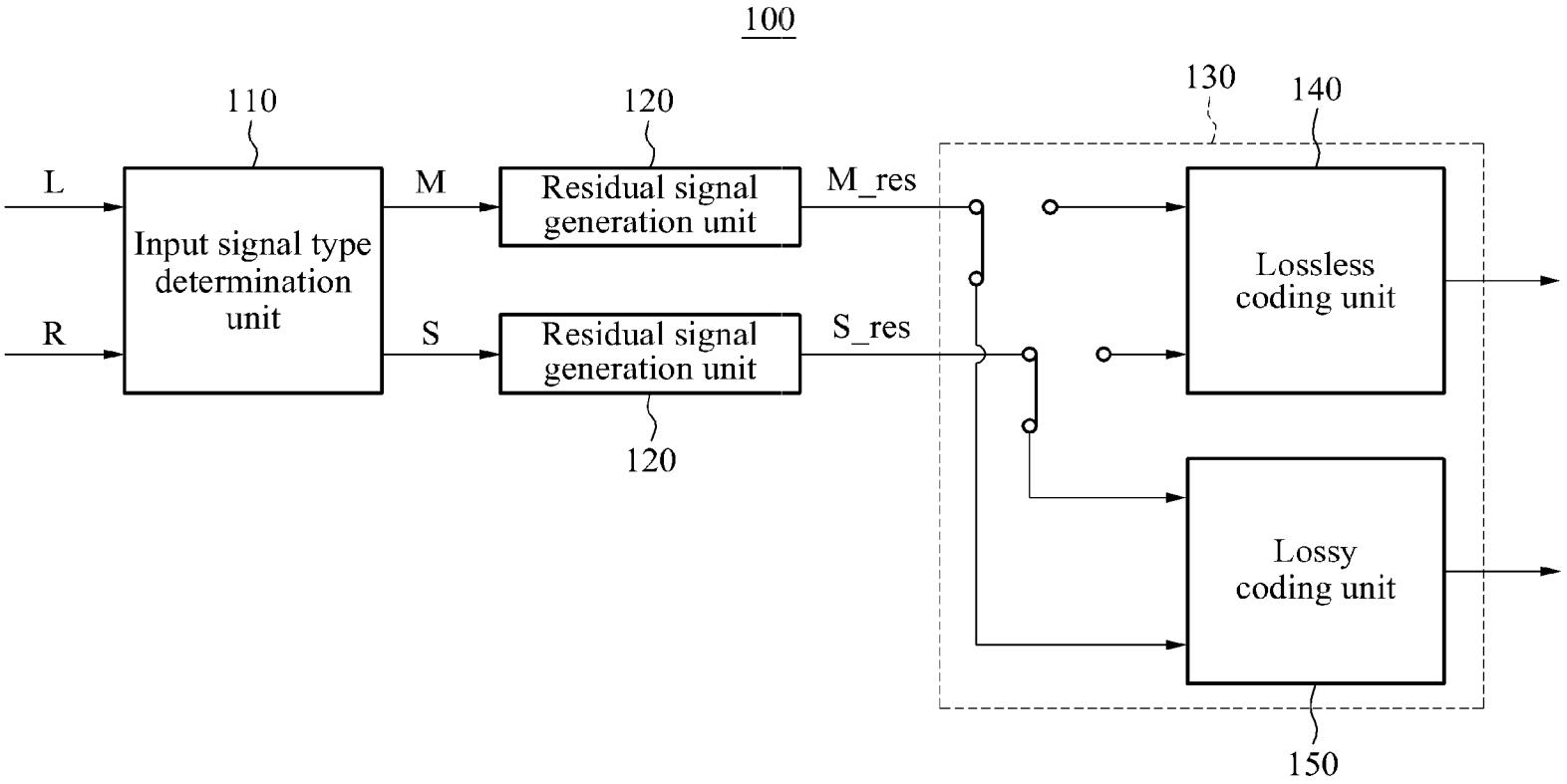
FIG. 1 illustrates a detailed configuration of an audio encoding apparatus according to an exemplary embodiment.

Hereinafter, exemplary embodiments will be described with reference to the accompanying drawings. Specific structural and functional descriptions to be mentioned below are provided so as to illustrate exemplary embodiments only and the following exemplary embodiments are construed as limiting the scope of the invention. Like reference numerals refer to the like elements throughout.

FIG. 1 illustrates a detailed configuration of an audio encoding apparatus 100 according to an exemplary embodiment.

The audio encoding apparatus 100 may perform an optimal coding method based on characteristics of an input signal or purposes among lossless coding techniques and lossy coding techniques. The audio encoding apparatus 100 may determine an optimal coding method based on characteristics of an input signal. Accordingly, the audio encoding apparatus 100 may improve coding efficiency.

The audio encoding apparatus 100 may transform a residual signal into a signal in a frequency domain and quantize the residual signal that is transformed into the signal in the frequency domain so as to conduct lossy coding in addition to lossless coding. The audio encoding apparatus 100 allows an entropy coding method applied to lossy coding to employ an entropy coding module of lossless coding, thereby reducing structural complexity and performing lossless coding and lossy coding with a single structure.

Referring to FIG. 1, the audio encoding apparatus 100 may include an input signal type determination unit 110, a residual signal generation unit 120, and a coding unit 130.

The input signal type determination unit 110 may determine an output form of an input signal. The input signal may be a stereo signal including an L signal and an R signal. The input signal may be input by a frame to the audio encoding apparatus 100. The input signal type determination unit 110 may determine an output L/R type based on characteristics of the stereo signal.

When a frame size is represented as "N," the L signal and the R signal of the input signal may be expressed by Equation 1 and Equation 2, respectively.

$$L=[L(n), \ldots, L(n+N-1)^T] \quad \text{[Equation 1]}$$

$$R=[R(n), \ldots, R(n+N-1)^T] \quad \text{[Equation 2]}$$

For instance, the input signal type determination unit 110 may determine based on the L signal, the R signal and a sum signal of the L signal and the R signal whether the input signal is changed. An operation that the input signal type determination unit 110 determines the output form of the input signal will be described in detail with reference to FIG. 2.

The residual signal generation unit 120 may generate a residual signal based on an output signal from the input signal type determination unit 110. For example, the residual signal generation unit 120 may generate a linear predictive coding (LPC) residual signal. The residual signal generation unit 120 may employ methods widely used in the art, such as LPC, to generate the residual signal.

FIG. 1 shows an M signal and an S signal as the output signal from the input signal type determination unit 110, and the M signal and the S signal are input to the residual signal generation unit 120. The residual signal generation unit 120 may output an M_res signal as a residual signal of the M signal and an S_res signal as a residual signal of the S signal.

The coding unit 130 may perform lossless coding or lossy coding using the residual signals. Lossless coding is carried out when quality of an audio signal is considered more important, while lossy coding is carried out to acquire higher encoding rate. The coding unit 130 may include a lossless coding unit 140 to conduct lossless coding and a lossy coding unit 150 to conduct lossy coding. The residual signals, which are the M_res signal and the S_res signal, may be input to the lossless coding unit 140 or the lossy coding unit 150 based on a coding method. The lossless coding unit 140 may conduct lossless coding using the residual signals to generate a bitstream. The lossy coding unit 150 may conduct lossy coding using the residual signals to generate a bitstream.

Operations of the lossless coding unit 140 will be described in detail with reference to FIG. 3, and operations of the lossy coding unit 150 will be described in detail with reference to FIG. 6.

The bitstream generated by coding an audio signal is transmitted to an audio decoding apparatus and decoded by the audio decoding apparatus, thereby reconstructing the original audio signal.

Figure 2:
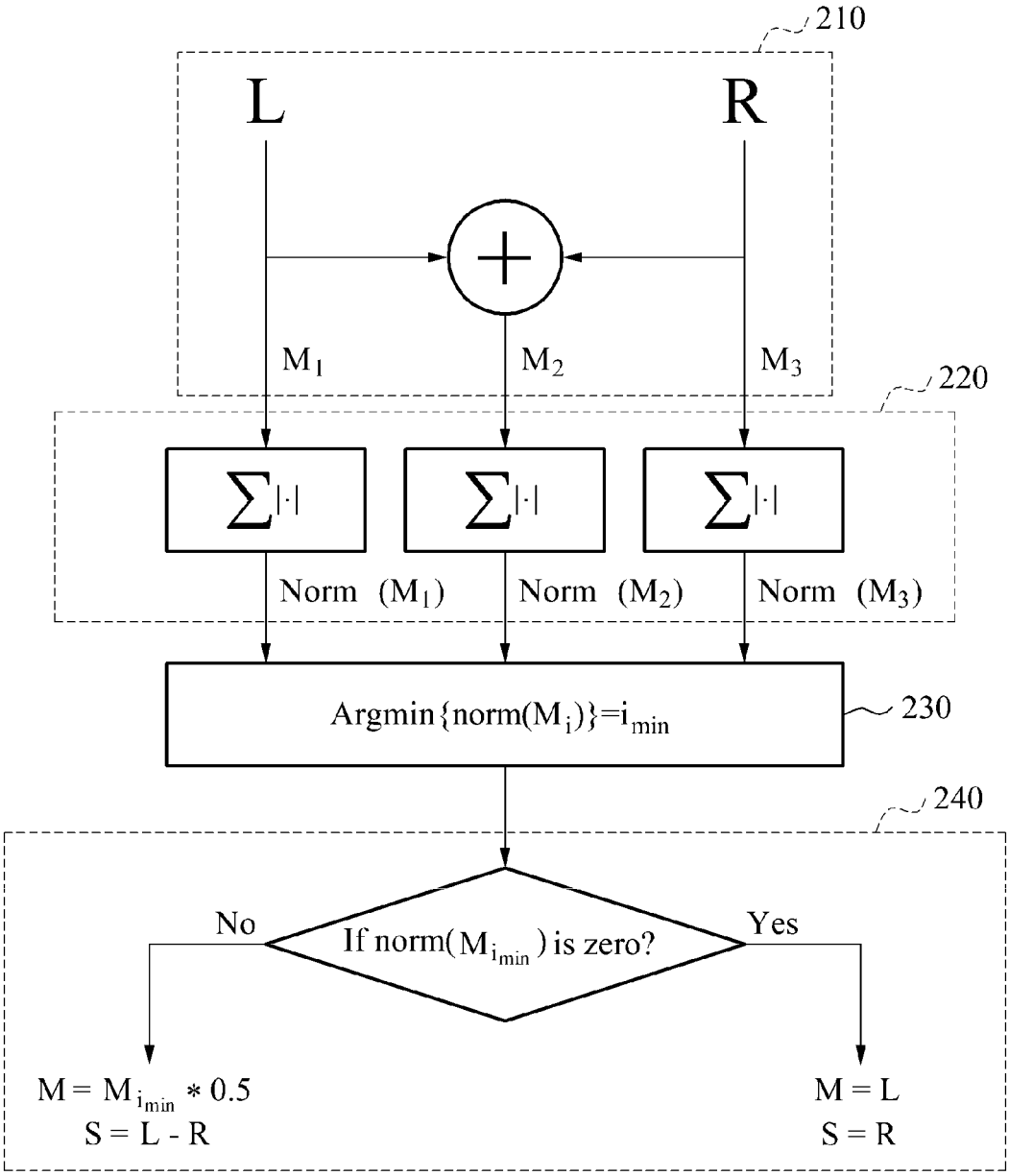
FIG. 2 illustrates an operation of an input signal type determination unit according to an exemplary embodiment.

FIG. 2 illustrates an operation of the input signal type determination unit according to an exemplary embodiment.

The input signal type determination unit may determine an output type of an input signal according to an operation process illustrated in FIG. 2 when a stereo signal as the input signal is input by a frame.

In operation 210, the input signal type determination unit may determine an $M_1$ signal, an $M_2$ signal and an $M_3$ signal based on input L and R signals. For example, the input signal type determination unit may map the input signals, such as "$M_1$ signal=L signal," "$M_2$ signal=L signal+R signal" and "$M_3$ signal=R signal."

In operation 220, the input signal type determination unit may calculate a sum of absolute values of the $M_1$ signal, the $M_2$ signal and the $M_3$ signal. As a result of operation 220, a norm($M_1$) for the $M_1$ signal, a norm($M_2$) for the $M_2$ signal and a norm($M_3$) for the $M_3$ signal may be obtained.

In operation 230, the input signal type determination unit may determine a $M_{i_{min}}$ signal having a minimum norm(·) among the $M_1$ signal, the $M_2$ signal and the $M_3$ signal. The $M_{i_{min}}$ signal may be any one of the $M_1$ signal, the $M_2$ signal and the $M_3$ signal.

In operation 240, the input signal type determination unit may determine whether the minimum norm(·) is 0. A value of the minimum norm(·) may be expressed as norm($M_{i_{min}}$).

When norm($M_{i_{min}}$) is 0, the input signal type determination unit may output the output signals of the input signal type determination unit, the M signal and the S signal, as the L signal and the R signal, respectively. That is, when norm($M_{i_{min}}$) is 0, the input signal type determination unit may determine the output signals such that "M signal=L signal" and "S signal=R signal."

When norm($M_{i_{min}}$) is not 0, the input signal type determination unit may determine the output signals such that "M signal=$M_{i_{min}}$ signal*0.5" and "S signal=L signal−R signal."

According to the foregoing process, the input signal type determination unit may output the M signal and the S signal with the input L and R signals.

Figure 3:
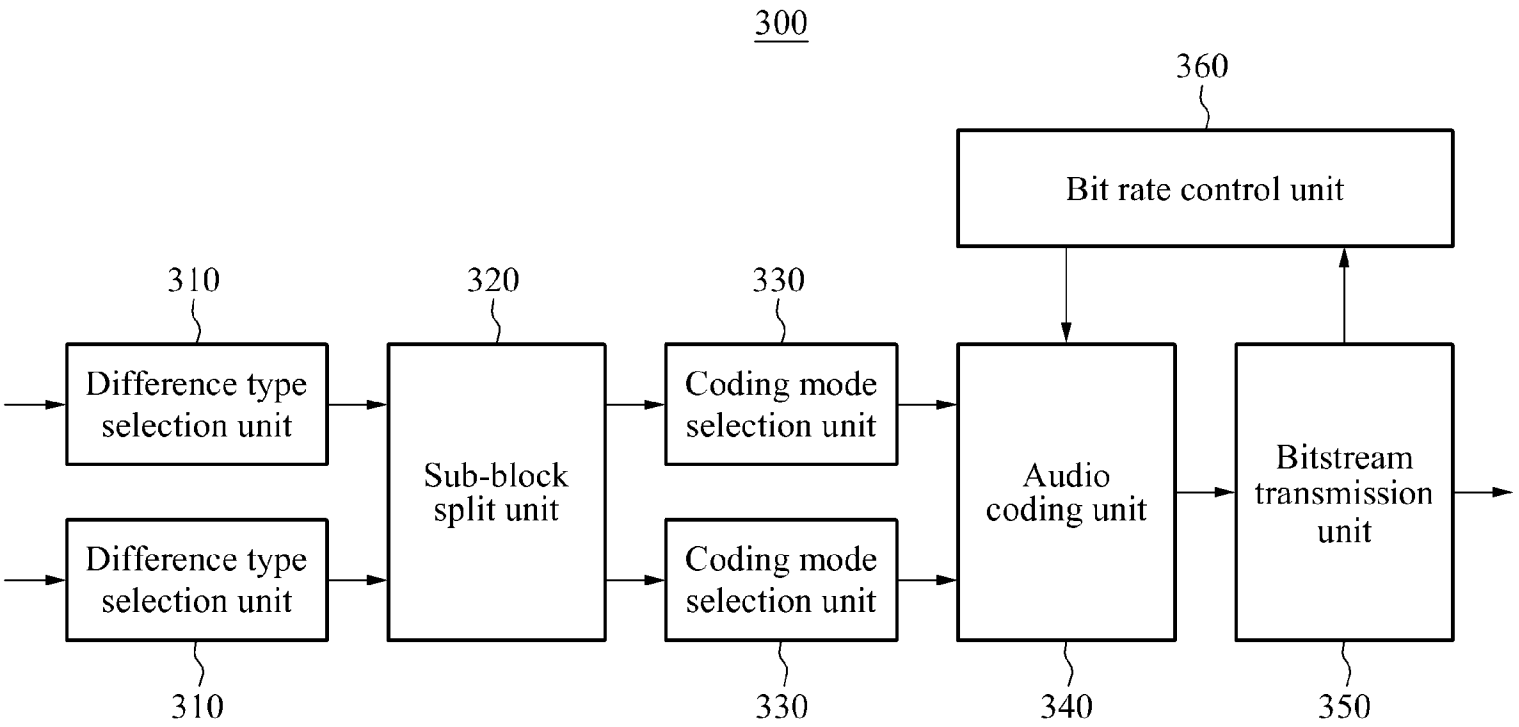
FIG. 3 illustrates a detailed configuration of a lossless coding unit according to an exemplary embodiment.

FIG. 3 illustrates a detailed configuration of a lossless coding unit 300 according to an exemplary embodiment.

Referring to FIG. 3, the lossless coding unit 300 may include a difference type selection unit 310, a sub-block split unit 320, a coding mode selection unit 330, an audio coding unit 340, a bit rate control unit 360 and a bitstream transmission unit 350.

The difference type selection unit 310 may perform a differential operation so as to reduce a dynamic range of a residual signal, thereby outputting a residual signal with a reduced dynamic range. The difference type selection unit 310 outputs M_res_diff and S_res_diff signals with input residual signals M_res and S_res. The M_res_diff and S_res_diff signals are signals by frames, which may be expressed in an equivalent or similar form to that of Equation 1.

The sub-block split unit 320 may split the output signals from the difference type selection unit 310 into a plurality of sub-blocks. The sub-block split unit 320 may split the M_res_diff and S_res_diff signals into sub-blocks with a uniform size based on characteristics of the input signals. For example, a process of splitting the M_res_diff signal may be expressed by Equation 3.

$$M_\text{res_diff}=[m_\text{res_diff}(n), \ldots, m_\text{res_diff}(n+N-1)]^T=[m_\text{res_diff}_0, \ldots, m_\text{res_diff}_{K-1}]^T$$

$$m_\text{res_diff}_j=[m_\text{res_diff}(j\times M), \ldots, m_\text{res_diff}(j\times M+M-1)]^T \quad \text{[Equation 3]}$$

Here, $$K=\left\lfloor \frac{N}{M} \right\rfloor,$$

and N and M is set to a square of 2 for convenience so that K becomes an integer. M may be determined by various methods. For example, M may be determined by analyzing stationary properties of an input frame signal, by statistical properties based on an average value and a variance, or by an actually calculated coding gain. M may be defined by various methods, not limited to the foregoing examples.

A sub-block $m_\text{res_diff}_j$ may be obtained from Equation 3. The S_res_diff signal may be also split in the same manner as the process of splitting the M_res_diff signal, and accordingly a sub-block $s_\text{res_diff}_j$ may be obtained in the same way as for the M_res_signal. The sub-block $m_\text{res_diff}_j$ or the sub-block sub-block $s_\text{res_diff}_j$ may be encoded by various encoding methods.

The coding mode selection unit 330 may select a coding mode for coding the sub-block $m_\text{res_diff}_j$ or the sub-block sub-block $s_\text{res_diff}_j$. In one exemplary embodiment, the coding mode may be determined based on two modes, "open loop" and "closed loop." In the "open loop" mode, the coding mode selection unit 330 determines a coding mode. In the "closed loop" mode, instead of determining a coding mode by the coding mode selection unit 330, each coding mode is tested for encoding an input signal and then a coding mode with best coding performance is selected. For example, in the "closed loop" mode, a coding mode to encode an input signal into a smallest bit may be selected.

For instance, the coding mode may include Normal Rice Coding, Entropy Rice Coding, pulse code modulation (PCM) Rice Coding and Zero Block Coding. The coding mode selection unit 330 may determine any coding mode among Normal Rice Coding, Entropy Rice Coding, PCM Rice Coding and Zero Block Coding. In PCM Rice Coding mode, a coding mode is determined based on a closed loop mode.

Each coding mode is described as follows.

(1) When Zero Block Coding is selected, only a mode bit is transmitted. Since there are four coding modes, coding mode information is possibly transmitted with two bits. For example, suppose that a coding mode is allocated such that "00: Zero Block Coding, 01: Normal Rice Coding, 02: PCM Rice Coding, and 03: Entropy Rice Coding." When a "00" bit is transmitted, the audio decoding apparatus may identify that the coding mode conducted by the audio encoding apparatus is Zero Block Coding and generate "Zero" signals corresponding to a size of sub-blocks. To transmit the Zero Block Coding mode, only bit information indicating a coding mode is needed.

(2) Normal Rice Coding indicates a general Rice coding mode. In Rice Coding mode, a number by which an input signal is divided is determined, and the input signal with the determined number is expressed with an exponent and a mantissa. A method of coding the exponent and the mantissa is the same as conventional Rice Coding. For example, a unary coding method may be used to code the exponent, while a binary coding method may be used to code the mantissa. In Normal Rice Coding, the number $D_{normal}$ by which the input signal is divided may be determined based on Equation 4.

$$D_{normal}=2^{[\log_2(Max_value)]-\alpha} \quad \text{[Equation 4]}$$

Equation 4 shows that the number $D_{normal}$ by which the input signal is divided is determined such that a maximum value Max_value is at most $2^{\alpha}$, which means that an exponent of the maximum value is $2^{\alpha}$ or lower.

In Normal Rice Coding, the exponent and the mantissa may be expressed by Equation 5.

$$\begin{aligned}
&\text{Exponent} = [exponent_0, \ldots, exponent_{K-1}]^T = \left[\left\lfloor \frac{\text{m_res_diff(n)}}{D_{normal}} \right\rfloor, \ldots, \left\lfloor \frac{\text{m_res_diff(n+N-1)}}{D_{normal}} \right\rfloor\right]^T \\
&exponent_j = [exponent(j\times M), \ldots, \text{exponent}(j\times M+M-1)]^{\bar{T}} \\
&\text{Mantissa} = [mantissa_0, \ldots, mantissa_{K-1}]^{\bar{T}} = \left[\text{rem}\left(\frac{\text{m_res_diff(n)}}{D_{normal}}\right), \ldots, \text{rem}\left(\frac{\text{m_res_diff(n+N-1)}}{D_{normal}}\right)\right]^T \\
&mantissa_j = [\text{mantissa}(j\times M), \ldots, \text{mantissa}(j\times M+M-1)]^{\bar{T}}
\end{aligned} \quad \text{[Equation 5]}$$

An exponent and a mantissa of the $s_res_diff_j$ signal may be also acquired based on the same process as described above.

(3) PCM Rice Coding indicates that PCM coding is performed on the input signal. A PCM bit allocated to each sub-block may vary and be determined based on the maximum value Max_value of the input signal. For example, a PCM bit $PCM_bits_{normal}$ in PCM Rice Coding, compared with Normal Rice Coding, may be expressed by Equation 6.

$$PCM_bits_{normal}=\lceil \log_2(\text{Max_value})\rceil \quad \text{[Equation 6]}$$

Equation 6 is applied to PCM Rice Coding, compared with Normal Rice Coding.

A PCM bit $PCM_bits_{entropy}$ in PCM Rice Coding, compared with Entropy Rice Coding, may be determined by Equation 7.

$$PCM_bits_{entropy}=\lceil \log_2(\text{Max}(\text{exponents}_j))\rceil \quad \text{[Equation 7]}$$

In Equation 7, exponents are acquired by Entropy Rice Coding.

(4) In Entropy Rice Coding, a number $D_{entropy}$ by which the input signal is divided may be determined based on Equation 8.

$$D_{entropy}=2^{[\log_2(Max_value)]-[\log_2(codebook_size)]} \quad \text{[Equation 8]}$$

Here, codebook_size denotes a size of a codebook when Huffman Coding is applied as Entropy Coding. In Entropy Rice Coding, an exponent and a mantissa may be expressed by Equation 9.

$$\begin{aligned}
&\text{Exponent} = [exponent_0, \ldots, exponent_{K-1}]^T = \left[\left\lfloor \frac{\text{m_res_diff(n)}}{D_{normal}} \right\rfloor, \ldots, \left\lfloor \frac{\text{m_res_diff(n+N-1)}}{D_{normal}} \right\rfloor\right]^T \\
&exponent_j = [\text{exponent}(j\times M), \ldots, \text{exponent}(j\times M+M-1)]^{\bar{T}} \\
&\text{Mantissa} = [mantissa_0, \ldots, mantissa_{K-1}]^{\bar{T}} = \left[\text{rem}\left(\frac{\text{m_res_diff(n)}}{D_{normal}}\right), \ldots, \text{rem}\left(\frac{\text{m_res_diff(n+N-1)}}{D_{normal}}\right)\right]^T \\
&mantissa_j = [\text{mantissa}(j\times M), \ldots, \text{mantissa}(j\times M+M-1)]^{\bar{T}}
\end{aligned} \quad \text{[Equation 9]}$$

An exponent and a mantissa of the $s_res_diff_j$ signal may be also acquired based on the same process as described above.

When the exponent and the mantissa are acquired, the mantissa is coded by the same binary coding as in Normal Rice Coding. The exponent is coded by Huffman coding, in which at least one table may be used. Entropy Rice Coding will be described in detail with reference to FIG. 5.

The audio coding unit 340 may code the audio signal based on the coding mode selected by the coding mode selection unit 330. The audio coding unit 340 may output a bitstream generated by coding to the bitstream transmission unit 350.

In one exemplary embodiment, the coding mode selection unit 330 may determines to perform a plurality of coding modes, in which case the audio coding unit 340 may compare sizes of bitstreams generated by the respective coding modes to determine a bitstream to be ultimately output. The audio coding unit 340 may finally output a bitstream with a smaller size among the bitstreams generated by the plurality of coding modes. The bitstream transmission unit 350 may transmit the finally output bitstream out of the audio encoding apparatus.

The "open loop" mode that the coding mode selection unit 330 selects a coding mode will be described in detail with reference to FIG. 4.

The bit rate control unit 360 may control a bit rate of the generated bitstream. The bit rate control unit 360 may control the bit rate by adjusting a bit allocation of the mantissa. When a bit rate of a bitstream generated by coding a previous frame exceeds a target bit rate, the bit rate control unit 360 may forcibly limit a resolution of a bit currently applied to lossless coding. The bit rate control unit 360 may prevent an increase in bit count by forcibly limiting the resolution of the bit used for lossless coding. Ultimately, a lossy coding operation may be conducted even in the lossless coding mode. The bit rate control unit 360 may limit a mantissa bit determined by $D_{entropy}$ or $D_{normal}$ so as to forcibly limit the resolution.

A number (#) of mantissa bits at Normal Rice Coding may be expressed by Equation 10.

$$\text{\# of mantissa bits at Normal Rice coding}=M_\text{bits}_{normal}=2^{D_{normal}} \quad \text{[Equation 10]}$$

A number (#) of mantissa bits at Entropy Rice Coding may be expressed by Equation 11.

$$\text{\# of mantissa bits at Entropy Rice coding}=M_\text{bits}_{entropy}=2^{D_{entropy}} \quad \text{[Equation 11]}$$

To decrease the bit rate, the bit rate control unit 360 may reduce $M_\text{bits}_{normal}$ and $M_\text{bits}_{entropy}$ such that $M_\text{bits}_{normal}=M_\text{bits}_{normal}-1$ and $M_\text{bits}_{entropy}=M_\text{bits}_{entropy}-1$. When a reduction is insufficient, the bit rate control unit 360 may increase deductions from $M_\text{bits}_{normal}$ or $M_\text{bits}_{entropy}$ integer times, such as −2, −3, or the like, and conduct coding in each case, thereby selecting optimal $M_\text{bits}_{normal}$ or $M_\text{bits}_{entropy}$.

Figure 4:
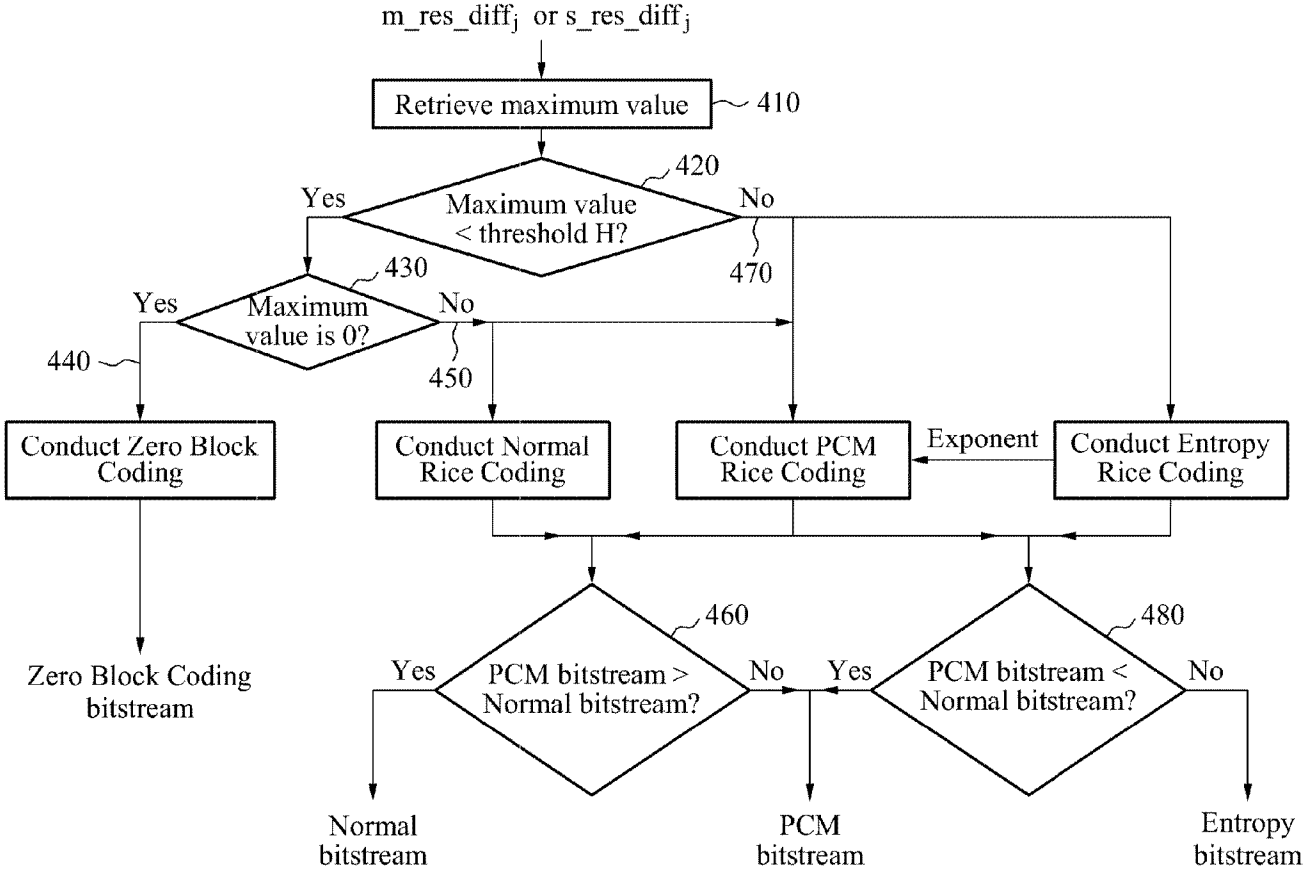
FIG. 4 is a flowchart illustrating an operation of a coding mode selection unit determining a coding mode according to an exemplary embodiment.

FIG. 4 is a flowchart illustrating an operation of the coding mode selection unit determining a coding mode according to an exemplary embodiment.

When the sub-block $m_\text{res}_\text{diff}_j$ or sub-block $s_\text{res}_\text{diff}_j$ is input, the coding mode selection unit acquires an absolute value of each sub-block and retrieve a maximum value in operation 410.

The coding mode selection unit determines whether the retrieved maximum value is smaller than a preset threshold H in operation 420. For example, the threshold H may indicate a size of a Huffman codebook used for Entropy Rice Coding. When the size of the Huffman codebook is 400, the threshold H is set to 400.

When the maximum value of the sub-block is smaller than the threshold H, the coding mode selection unit may check whether the maximum value of the sub-block is 0 in operation 430.

When the maximum value of the sub-block is 0, the coding mode selection unit chooses to conduct Zero Block Coding in operation 440. As a result of Zero Block Coding, a Zero Block Coding bitstream may be output.

When the maximum value of the sub-block is not 0, the coding mode selection unit may choose to conduct Normal Rice Coding and PCM Rice Coding in operation 450. Subsequently, the audio coding unit may compare a size of a bitstream generated by Normal Rice Coding (hereinafter, referred to as a "Normal bitstream") with a size of a bitstream generated by PCM Rice Coding (hereinafter, referred to as a "PCM bitstream") in operation 460. When the size of the PCM bitstream is greater than the size of the Normal bitstream, the bitstream coded by Normal Rice Coding may be output. On the contrary, when the size of the PCM bitstream is not greater than the size of the Normal bitstream, the bitstream coded by PCM Rice Coding may be output.

When the maximum value of the sub-block is not smaller than the threshold H, the coding mode selection unit may choose to conduct PCM Rice Coding and Entropy Rice Coding in operation 470. Subsequently, the audio coding unit may compare a size of a PCM bitstream with a size of a bitstream generated by Entropy Rice Coding (hereinafter, referred to as an "Entropy bitstream") in operation 480. When the size of the PCM bitstream is smaller than the size of the Entropy bitstream, the bitstream coded by PCM Rice coding may be output. On the contrary, when the size of the PCM bitstream is not smaller than the size of the Entropy bitstream, the bitstream coded by Entropy Rice coding may be output.

Figure 5:
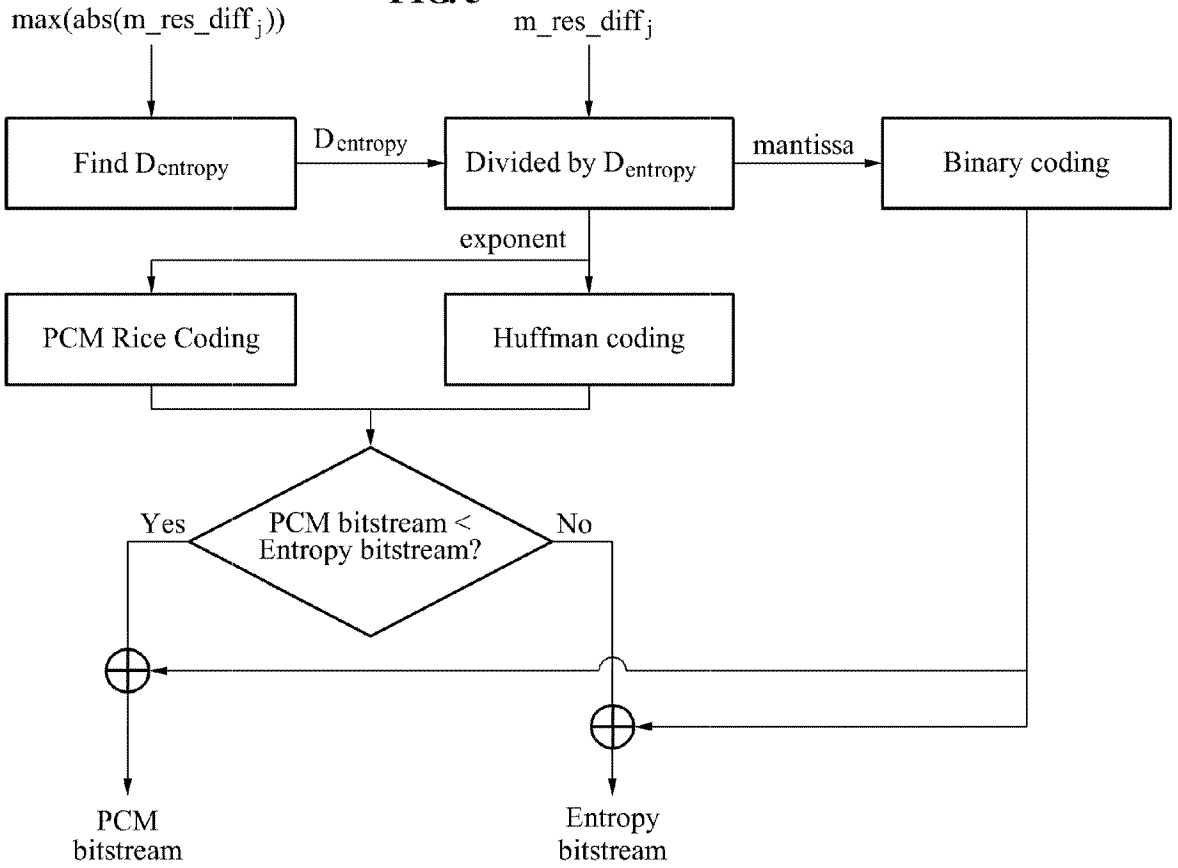
FIG. 5 is a flowchart illustrating an Entropy Rice Coding process according to an exemplary embodiment.

FIG. 5 is a flowchart illustrating an Entropy Rice Coding process according to an exemplary embodiment.

Referring to FIG. 5, as compared with Entropy Rice Coding, in PCM Rice Coding, PCM Coding is performed only on an exponent. A mantissa is shared with Entropy Rice Coding, which is a distinguished feature from PCM Coding, compared with Normal Rice Coding.

Figure 6:
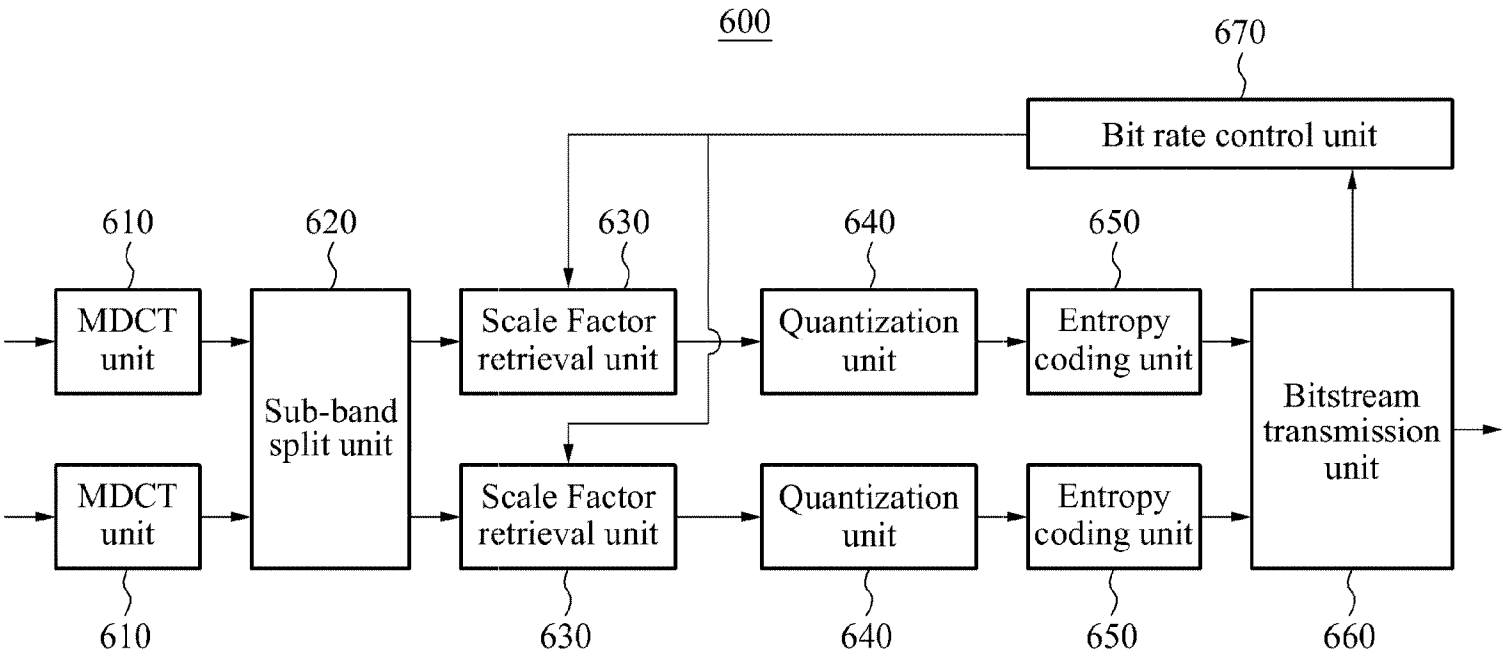
FIG. 6 illustrates a detailed configuration of a lossy coding unit according to an exemplary embodiment.

FIG. 6 illustrates a detailed configuration of the lossy coding unit according to an exemplary embodiment.

Referring to FIG. 6, a lossy coding unit 600 may include a modified discrete cosine transform (MDCT) unit 610, a sub-band split unit 620, a scale factor retrieval unit 630, a quantization unit 640, an entropy coding unit 650, a bit rate control unit 670, and a bitstream transmission unit 660.

The lossy coding unit 600 basically performs quantization in a frequency domain and uses an MDCT method. In lossy coding, quantization in a general frequency domain is carried out. Since a signal transformed by MDCT is a residual signal, a psychoacoustic model for quantization is not employed.

The MDCT unit 610 performs MDCT on the residual signal. The residual signal M_res and the residual signal S_res output from the residual signal generation unit of FIG. 1 are input to the MDCT unit 610. The MDCT unit 610 transforms the M_res signal and the S_res signal into signals in frequency domains. The M_res signal and the S_res signal transformed into the signals in the frequency domains may be expressed by Equation 12.

$$M_\text{res}_f=\text{MDCT}\{M_\text{res}\}=[m_\text{res}_f(0), \ldots, m_\text{res}_f(N-1)]^T$$

$$S_\text{res}_f=_\text{MDCT}\{S_\text{res}\}=[S_\text{res}_f(0), \ldots, S_\text{res}_f(N-1)]^T \quad \text{[Equation 12]}$$

Hereinafter, a time index of a frame is omitted for convenience, and a process of coding one frame signal will be described.

The sub-band split unit 620 may split an M_res_f signal and an S_res_f signal, obtained by transforming the M_res signal and the S_res signal into the signals in the frequency domains, into sub-bands. For example, the M_res_f signal split into the sub-bands may be expressed by Equation 13.

$$M_\text{res}_f=[m_\text{res}_f_0, \ldots, m_\text{res}_f_{B-1}]^T$$

$$m_\text{res}_f_j=[m_\text{res}_f(A_{b-1}), \ldots, m_\text{res}_f(A_b-1)]^T \quad \text{[Equation 13]}$$

Here, B denotes a number of sub-bands, wherein each sub-band is separated by a sub-band boundary index $A_b$.

The scale factor retrieval unit 630 may retrieve a scale factor with respect to the residual signal, transformed into the frequency domain, then split into the sub-bands. The scale factor may be retrieved by each sub-band.

The quantization unit 640 may quantize an output signal from the sub-band split unit 620, a residual signal in the frequency domain split into the sub-bands, using a quantized scale factor. The quantization unit 640 may quantize the scale factor using a method used in the art. For example, the quantization unit 640 may quantize the scale factor using general scalar quantization.

The quantization unit 640 may quantize the residual signal in the frequency domain split into the sub-bands based on Equations 14 and 15.

$$ScaleFactor = [sf_0, \ldots, sf_{B-1}]^T \quad \text{[Equation 14]}$$

$$sf_j = \sum_{k=A_{b-1}}^{A_b-1} \text{m_res_f(k)}$$

$$sf_j' = 2^{\log_2[Quant(sf_j)]-\delta}$$

A frequency bin of each sub-band is divided by quantized $sf_j'$. That is, signals by the sub-bands are divided into exponent and mantissa components by $sf_j'$.

[Equation 15]

$$\text{m_res_f}_j/sf_j' = [\text{m_res_f}(A_{b-1})/sf', \ldots, \text{m_res_f}(A_b-1)/sf']^T$$
$$= [(\text{m_exp}_0, \text{m_man}_0), \ldots, (\text{m_exp}_j, \text{m_man}_j)]^T$$

In Equation 14, δ denotes a factor to adjust quantization resolution of an exponent and a mantissa. When δ increases by one, a dynamic range of the exponent may be reduced but a mantissa bit may increase by one bit. On the contrary, when δ decreases by one, the mantissa bit may decrease by one bit but the dynamic range of the exponent increases and thus an exponent bit may increase.

The entropy coding unit 650 may perform entropy coding on the output signal from the quantization unit 640. The entropy coding unit 650 may code the exponent and the mantissa. The entropy coding unit 650 may code the exponent and the mantissa using a lossless Entropy Rice Coding module. A Huffman table of the exponent applied to Entropy Rice Coding may be used through separate training.

The bit rate control unit 670 may control a bit rate of the generated bitstream. The bit rate control unit 670 may control the bit rate by adjusting the allocated mantissa bit. When a bit rate of a bitstream generated by coding a previous frame exceeds a target bit rate, the bit rate control unit 670 may forcibly limit a resolution of a bit currently applied to lossy coding.

The bitstream transmission unit 660 may transmit the finally output bitstream out of the audio encoding apparatus.

Figure 7:
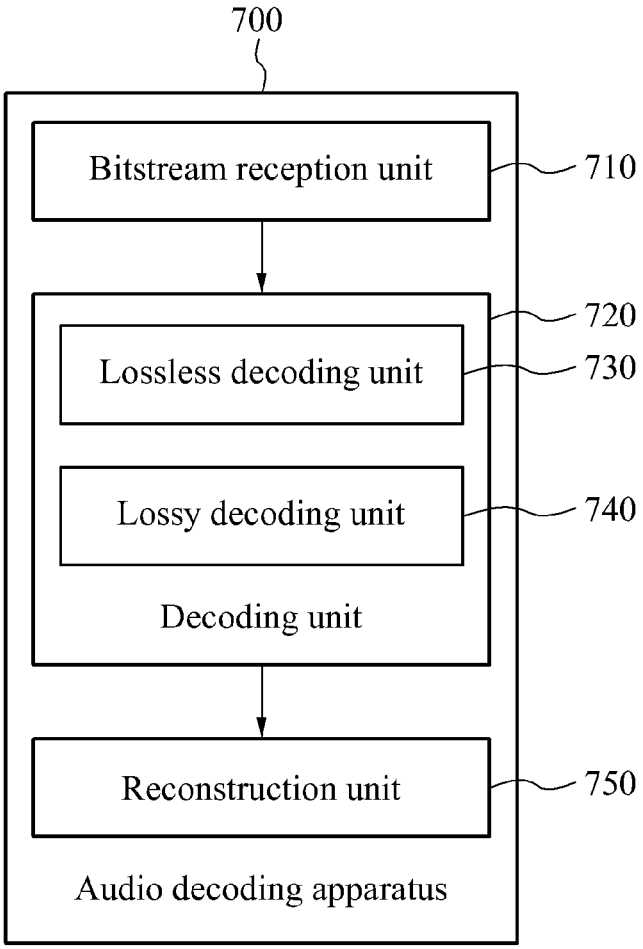
FIG. 7 illustrates a configuration of an audio decoding apparatus according to an exemplary embodiment.

FIG. 7 illustrates a configuration of an audio decoding apparatus 700 according to an exemplary embodiment.

Referring to FIG. 7, the audio decoding apparatus 700 may include a bitstream reception unit 710, a decoding unit 720 and a reconstruction unit 750. The decoding unit 720 may include a lossless decoding unit 730 and a lossy decoding unit 740.

The bitstream reception unit 710 may receive a bitstream including a coded audio signal from the outside.

The decoding unit 720 may determine based on the bitstream whether the audio signal is coded by lossy coding or lossless coding. The decoding unit 720 may perform lossless decoding or lossy decoding on the bitstream based on the coding mode. The decoding unit 720 may include the lossless decoding unit 730 to decode a signal coded by lossless coding and the lossy decoding unit 740 to decode a signal coded by lossy coding. As a result of lossy decoding or lossless decoding, residual signals, M_res and the S_res, may be reconstructed.

The reconstruction unit 750 may reconstruct the original audio signal using the residual signals generated by lossless decoding or lossy decoding. The reconstruction unit 750 may include a forward synthesis unit (not shown) corresponding to the residual signal generation unit 120 of FIG. 1 and an L/R type decoding unit (not shown) corresponding to the input signal type determination unit 110 of FIG. 1. The forward synthesis unit may reconstruct an M signal and an S signal based on the residual signals M_res and S_res reconstructed in the decoding unit. The L/R type decoding unit may reconstruct an L signal and an R signal based on the M signal and the S signal. A process of reconstructing the L signal and the R signal has been mentioned with reference to FIG. 2.

Figure 8:
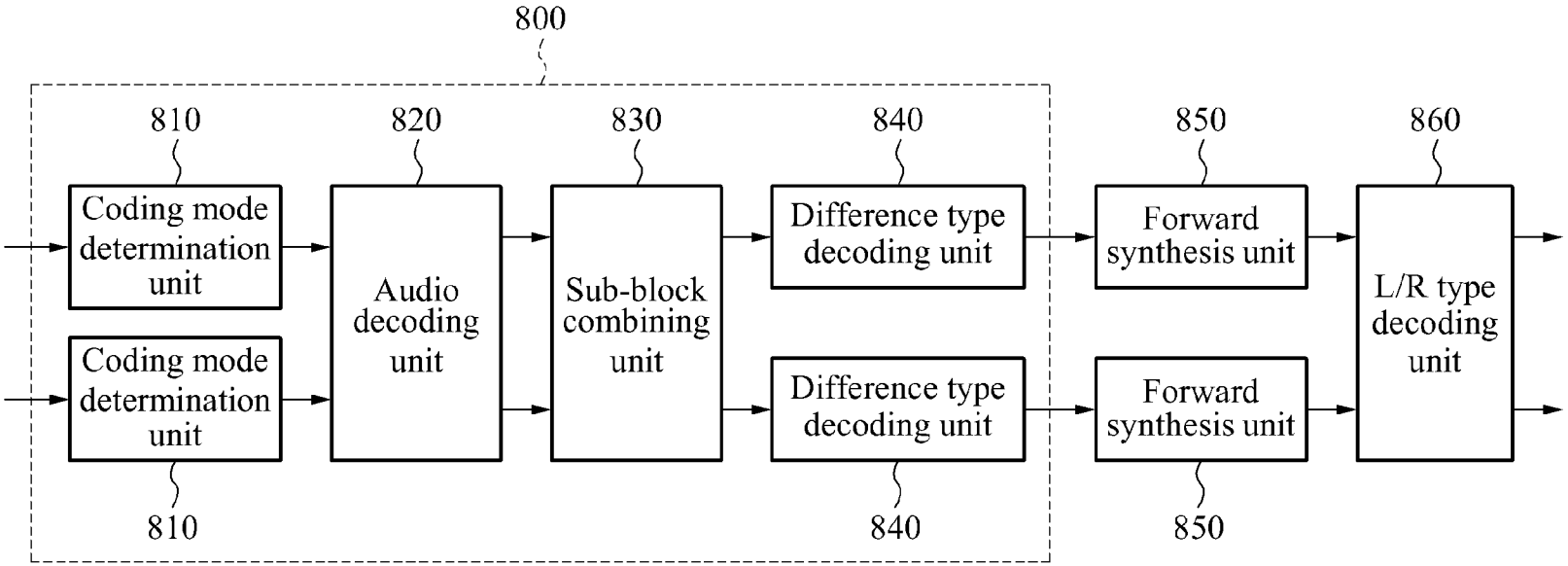
FIG. 8 illustrates a detailed configuration of a lossless decoding unit according to an exemplary embodiment.

FIG. 8 illustrates a detailed configuration of a lossless decoding unit 800 according to an exemplary embodiment.

Referring to FIG. 8, the lossless decoding unit 800 may include a coding mode determination unit 810, an audio decoding unit 820, a sub-block combining unit 830, and a difference type decoding unit 840.

A received bitstream may be divided into a bitstream of an M_res signal and a bitstream of an S_res signal and input to the coding mode determination unit 810. The coding mode determination unit 810 may determine a coding mode indicated in the input bitstreams. For example, the coding mode determination unit 810 may determine which coding mode is used to code the audio signal among Normal Rice Coding, PCM Rice Coding, Entropy Rice Coding and Zero Block Coding.

The audio decoding unit 820 may decode the bitstreams based on the coding mode determined by the coding mode determination unit 810. For example, the audio decoding unit 820 may select a decoding method based on the coding method of the audio signal among Normal Rice Decoding, PCM Rice Decoding, Entropy Rice Decoding and Zero Block Decoding and decode the bitstreams.

The sub-block combining unit 830 may combine sub-blocks generated by decoding. As a result of decoding, sub-blocks $\text{m_res_diff}_j$ and $\text{s_res_diff}_j$ may be reconstructed. The sub-block combining unit 830 may combine $\text{m_res_diff}_j$ signals to reconstruct an M_res_diff signal and combine $\text{s_res_diff}_j$ signals to reconstruct an S_res_diff signal. The difference type decoding unit 840 may reconstruct the residual signals based on the output signals from the sub-block combining unit 830. The difference type decoding unit 840 may reconstruct the M_res_diff signal into the residual signal M_res and reconstruct the S_res_diff signal into the residual signal S_res.

A forward synthesis unit 850 may reconstruct an M signal and an S signal based on the residual signals M_res and S_res reconstructed by the difference type decoding unit 840. An L/R type decoding unit 860 may reconstruct an L signal and an R signal based on the M signal and the S signal. The forward synthesis unit 850 and the L/R type decoding unit 860 may form the reconstruction unit 750 of the audio decoding apparatus 700. A process of reconstructing the L signal and the R signal has been mentioned with reference to FIG. 2.

Figure 9:
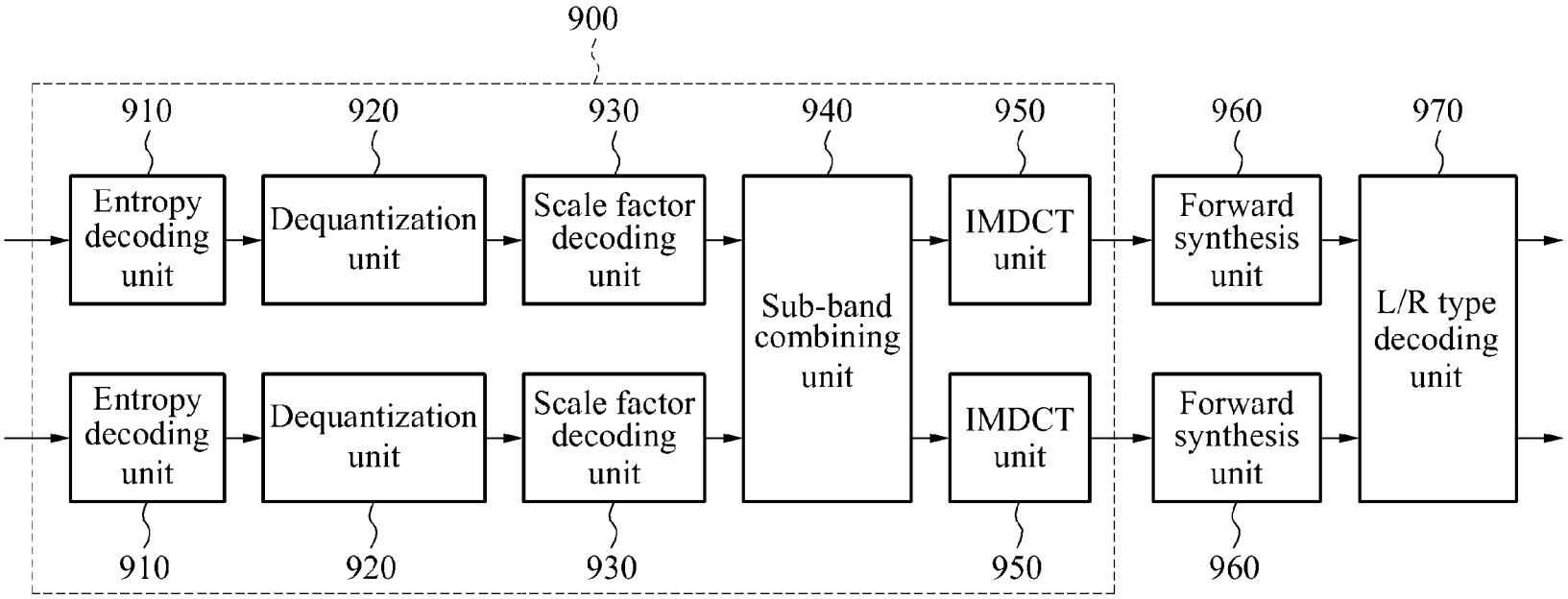
FIG. 9 illustrates a detailed configuration of a lossy decoding unit according to an exemplary embodiment.

FIG. 9 illustrates a detailed configuration of a lossy decoding unit 900 according to an exemplary embodiment.

Referring to FIG. 9, the lossy decoding unit 900 may include an entropy decoding unit 910, a dequantization unit 920, a scale factor decoding unit 930, a sub-band combining unit 940, and an inverse modified discrete cosine transform (IMDCT) unit 950.

A received bitstream may be divided into a bitstream of an M_res signal and a bitstream of an S_res signal and input to the entropy decoding unit 910. The entropy decoding unit 910 may decode a coded exponent and a coded mantissa from the bitstreams.

The dequantization unit 920 may dequantize a quantized residual signal based on the decoded exponent and the decoded mantissa. The dequantization unit 920 may dequantize residual signals by sub-bands using a quantized scale factor. The scale factor decoding unit 930 may dequantize the quantized scale factor.

The sub-band combining unit 940 may combine sub-bands that the residual signal is split into. The sub-band combining unit 940 may combine split sub-bands of an M_res_f signal split to reconstruct the M_res_f and combine split sub-bands of an S_res_f signal split to reconstruct the S_res_f, The IMDCT unit 950 may transform the output signals from the sub-band combining unit 940 from a frequency domain into a time domain. The IMDCT unit 950 may perform IMDCT on the reconstructed M_res_f signal to transform the M_res_f signal in the frequency domain into the time domain, thereby constructing an M_res signal. Likewise, the IMDCT unit 950 may perform IMDCT on the reconstructed S_res_f signal to transform the S_res_f signal in the frequency domain into the time domain, thereby constructing an S_res signal.

A forward synthesis unit 960 may reconstruct an M signal and an S signal based on the residual signals M_res and S_res reconstructed by the IMDCT unit. An L/R type decoding unit 970 may reconstruct an L signal and an R signal based on the M signal and the S signal. The forward synthesis unit 960 and the L/R type decoding unit 970 may form the reconstruction unit 750 of the audio decoding apparatus 700. A process of reconstructing the L signal and the R signal has been mentioned with reference to FIG. 2.

Figure 10:
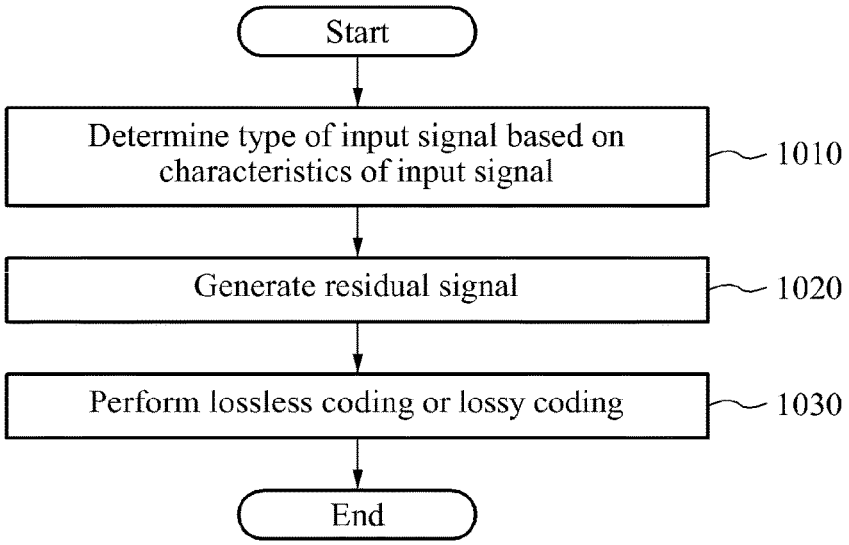
FIG. 10 is a flowchart illustrating an audio encoding method according to an exemplary embodiment.

FIG. 10 is a flowchart illustrating an audio encoding method according to an exemplary embodiment.

In operation 1010, the audio encoding apparatus may determine a type of an input signal based on characteristics of the input signal. The input signal may be a stereo signal including an L signal and an R signal. The input signal may be input by a frame to the audio encoding apparatus. The audio encoding apparatus may determine an output L/R type based on characteristics of the stereo signal. A process of determining the type of the input signal based on the characteristics of the input signal has been mentioned with reference to FIG. 2.

In operation 1020, the audio encoding apparatus may generate a residual signal based on the input signal the type of which is determined. The audio encoding apparatus may use widely used methods in the art, such as linear predictive coding (LPC), to generate the residual signal.

In operation 1030, the audio encoding apparatus may perform lossless coding or lossy coding using the residual signal.

When the audio encoding apparatus performs lossless coding, the audio encoding apparatus may perform a differential operation on the residual signal and split a signal generated by the differential operation into a plurality of sub-blocks. Subsequently, the audio encoding apparatus may select a coding mode for coding the sub-blocks and encode the sub-blocks based on the selected coding mode to generate a bitstream.

When the audio encoding apparatus performs lossy coding, the audio encoding apparatus may transform the residual signal into a signal in a frequency domain and split the residual signal, which is transformed into the signal in the frequency domain, into a sub-band. Subsequently, the audio encoding apparatus may retrieve a scale factor of the sub-band and quantize the scale factor. The audio encoding apparatus may quantize the sub-band using the quantized scale factor and perform entropy coding on the quantized sub-band. As a result of coding, a bitstream of a coded audio signal may be generated.

The audio encoding apparatus may control a bit rate of the bitstream by adjusting a resolution of a bit or a bit allocation applied to lossless coding or lossy coding. The bitstream of the coded audio signal may be transmitted to the audio decoding apparatus.

Figure 11:
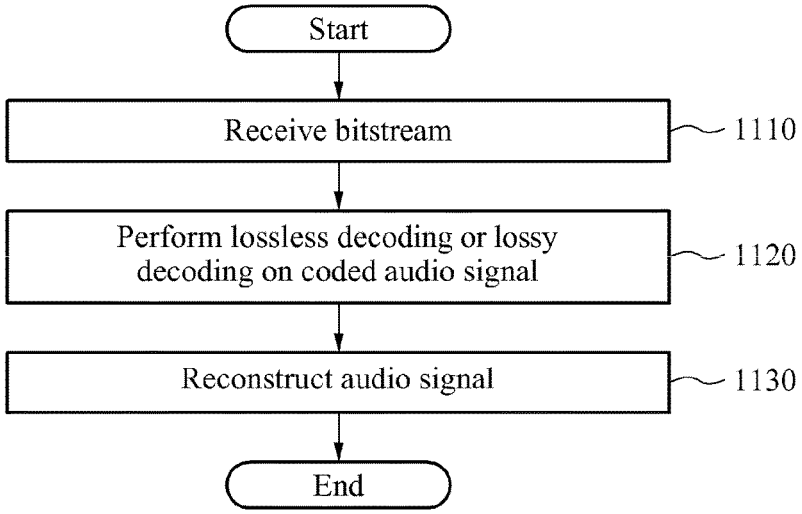
FIG. 11 is a flowchart illustrating an audio decoding method according to an exemplary embodiment.

FIG. 11 is a flowchart illustrating an audio decoding method according to an exemplary embodiment.

In operation 1110, the audio decoding apparatus may receive a bitstream including a coded audio signal.

In operation 1120, the audio decoding apparatus may perform lossless decoding or lossy decoding based on a coding method used to code the audio signal.

When the audio decoding apparatus performs lossless decoding, the audio decoding apparatus may determine a coding mode represented in the bitstream and decode the bitstream based on the determined coding mode. Subsequently, the audio decoding apparatus may combine sub-blocks generated by the decoding and reconstruct a residual signal based on the combined sub-blocks.

When the audio decoding apparatus performs lossy decoding, the audio decoding apparatus may decode an exponent and a mantissa of an input signal from the bitstream and dequantize a quantized residual signal based on the decoded exponent and the decoded mantissa. Subsequently, the audio decoding apparatus may dequantize a quantized scale factor and combine sub-bands that a residual signal is split into. The audio decoding apparatus may transform the residual signal from a frequency domain into a time domain through IMDCT.

In operation 1130, the audio decoding apparatus may reconstruct an original audio signal using the residual signal generated by lossless decoding or lossy decoding. The audio decoding apparatus may reconstruct an M signal and an S signal based on a residual signal M_res and a residual signal S_res reconstructed in operation 1120. The audio decoding apparatus may reconstruct an L signal and an R signal based on the M signal and the S signal. A process of reconstructing the L signal and the R signal has been mentioned with reference to FIG. 2.

The methods according to the above-described exemplary embodiments of the present invention may be recorded in non-transitory computer-readable media including program instructions to implement various operations embodied by a computer. The media may also include, alone or in combination with the program instructions, data files, data structures, and the like. The program instructions recorded in the media may be designed and configured specially for the exemplary embodiments or be known and available to those skilled in computer software. Examples of non-transitory computer-readable media include magnetic media such as hard disks, floppy disks, and magnetic tape; optical media such as CD ROM discs and DVDs; magneto-optical media such as floptical disks; and hardware devices that are specially configured to store and perform program instructions, such as read-only memory (ROM), random access memory (RAM), flash memory, and the like. Examples of program instructions include both machine code, such as produced by a compiler, and files containing higher level code that may be executed by the computer using an interpreter. The described hardware devices may be configured to act as one or more software modules in order to perform the operations of the above-described exemplary embodiments of the present invention, or vice versa.

While a few exemplary embodiments have been shown and described with reference to the accompanying drawings, it will be apparent to those skilled in the art that various modifications and variations can be made from the foregoing descriptions. For example, adequate effects may be achieved even if the foregoing processes and methods are carried out in different order than described above, and/or the aforementioned elements, such as systems, structures, devices, or circuits, are combined or coupled in different forms and modes than as described above or be substituted or switched with other components or equivalents.

Thus, other implementations, alternative embodiments and equivalents to the claimed subject matter are construed as being within the appended claims.

The invention claimed is:

1. An audio encoding method processed by one or more processors comprising:

generating a residual signal using input signal based on LPC (Linear Predictive Coding); and performing lossless coding or lossy coding using the residual signal, wherein the lossless coding is related to coding the residual based on coding mode selected based on differential operation, wherein the coding mode is associated with coding the sub-blocks based on a maximum value of the sub-blocks and a preset threshold.

2. The audio encoding method of claim 1 wherein the lossless coding is related to a bit rate by adjusting a resolution of a bit applied to lossless coding.

3. The audio encoding method of claim 1, wherein the lossy coding is related to entropy coding using a quantized scale factor per sub-band.

4. The audio encoding method of claim 3, wherein the lossy coding is related to a bit rate of a bit stream by adjusting a bit allocation applied to lossy coding.

5. An audio decoding method comprising:

receiving a bitstream comprising a coded audio signal based on LPC (Linear Predictive Coding);

performing lossless decoding or lossy decoding for the code the audio signal; and reconstructing an original audio signal using a residual signal generated by the lossless decoding or lossy decoding, wherein the lossless decoding is related to coding the residual based on coding mode selected based on differential operation, wherein the coding mode is associated with coding the sub-blocks based on a maximum value of the sub-blocks and a preset threshold.

6. The audio decoding method of claim 5, wherein the lossless decoding is related to combine a plurality of sub-blocks based on a coding mode.

7. The audio decoding method of claim 5, wherein the lossy decoding is related to combine a plurality of sub-bands using a scale factor.

* * * * *